United States Patent [19]

Cutler

[11] Patent Number: 4,784,518

[45] Date of Patent: Nov. 15, 1988

[54] DOUBLE-STAGE REPAVING METHOD AND APPARATUS

[75] Inventor: Earl F. Cutler, Lawrence, Kans.

[73] Assignee: Cutler Repaving, Inc., Lawrence, Kans.

[21] Appl. No.: 121,897

[22] Filed: Nov. 17, 1987

[51] Int. Cl.[4] ..... E01C 23/14; E01C 19/00

[52] U.S. Cl. ..... 404/79; 404/82; 404/91; 404/95; 404/102; 404/92

[58] Field of Search ..... 404/75, 77, 79, 82, 404/90–92, 95, 101, 102

[56] References Cited

U.S. PATENT DOCUMENTS

| | | | |
|---|---|---|---|
| 3,361,042 | 1/1968 | Cutler | 404/90 X |
| 3,907,450 | 9/1975 | Cutler | 404/90 |
| 4,011,023 | 3/1977 | Cutler | 404/91 |
| 4,018,540 | 4/1977 | Jackson, Sr. | 404/95 |
| 4,103,973 | 8/1978 | Cutler | 299/39 |
| 4,124,325 | 11/1978 | Cutler | 404/90 X |
| 4,129,398 | 12/1978 | Schoelkopf | 404/90 X |
| 4,172,679 | 10/1979 | Wirtgen | 404/90 |
| 4,226,552 | 10/1980 | Moench | 404/91 X |
| 4,317,642 | 3/1982 | Wirtgen | 404/91 X |
| 4,347,016 | 8/1982 | Sindelar et al. | 404/95 |
| 4,407,605 | 10/1983 | Wirtgen | 404/90 X |
| 4,453,856 | 6/1984 | Chiostri et al. | 404/91 |
| 4,534,674 | 8/1985 | Cutler | 404/95 X |
| 4,682,909 | 7/1987 | Mihara | 404/90 |

*Primary Examiner*—Stephen J. Novosad

*Assistant Examiner*—John F. Letchford

*Attorney, Agent, or Firm*—Trexler, Bushnell, Giangiorgi & Blackstone, Ltd.

[57] ABSTRACT

The invention here disclosed comprises a method and apparatus for rejuvenating an asphalt roadway surface resulting in up to approximately three inches of new repaved roadway surface produced at speeds of up to approximately twenty-two feet per minute. The method includes the steps of heating a top layer of roadway, scarifying that heated layer, adding a recycling agent and thoroughly mixing and screeding the road surface to form a recycled material, adding new asphalt mix to the recycled material and milling the combination to form a mixed material and leaving a sub-layer plane in the roadbed. The mixed material is next conveyed away to a paving station located at the end of the process. During this conveying, the sub-layer left by the milling cut is heated, scarified, treated and worked in a manner similar to the treatment performed on the top layer of road surface. Finally, the mixed material is laid upon the now properly prepared sub-layer at a paving station and a new welded, monolithic, roadsurface is formed. The apparatus of the invention comprise means for performing the above described method steps and may be incorporated into a first vehicle having independent drive means and a second vehicle, also having independent drive means designed to follow first vehicle along the road surface being repaved.

13 Claims, 5 Drawing Sheets

DOUBLE-STAGE REPAVING METHOD AND APPARATUS

BACKGROUND OF THE INVENTION

This invention relates generally to methods and apparatus for roadway resurfacing, and more particularly to new and improved asphalt recycling methods and apparatus for rejuvenating old roadway surfaces into new highway pavements. Road resurfacing methods and apparatus such as are set forth in U.S. Pat. Nos. 3,361,042; 4,011,023; 4,103,973 and 4,124,325 provide means for resurfacing asphalt pavement surfaces by some of the most inexpensive and effective processes known to date.

As in most industries however, economic prosperity in the asphalt repaving business depends on continuing improvements in product quality and/or reductions in the cost of the product provided. This is especially true in the repaving business where the large majority of customers are either government agencies or municipalities generally operating under very restrictive fiscal budgets.

Most asphalt road surfaces are made up of a combination of stone, sand, and asphalt cement mixed together in appropriate proportions and under proper conditions. One of the most important mixing conditions is that of heating the asphalt components to temperatures high enough to liquify the asphalt cements and thereby allow them to spread evenly and uniformly bind the asphalt components together. The most comonly used asphalt cements become liquified somewhere around 200 degrees Farenheit, but unfortunately these cements also have relatively low flashpoints, usually around 475 degrees Farenheit. Therefore, the temperature during mixing must be carefully controlled to obtain a high quality product and avoid the danger of fire.

In a modern asphalt production factory, attaining proper conditions or mixing asphalt is not difficult. However, attempting to revitalize an existing roadway surface by mixing asphalt components already in the form of a road pavement proves a much more difficult task. This is large part due to the problems associated with penetrating sufficient amounts of heat into the existing asphalt road surface. For example, heating an upper surface of asphalt road to around 400 degrees Farenheit will create temperatures of about 200 degrees Farenheit approximately ¾ of an inch down into the asphalt, and only temperatures of around 120 degrees Farenheit at a depth of approximately one inch. Mixing together these various heated levels will produce a material having a fairly uniform temperature of approximately 300 degrees Farenheit, which is the minimum temperature needed to mix a high quality asphalt product. Trying to heat the upper surface much higher in an attempt to affect more than an inch of asphalt will likely set the surface on fire and burn it. Burning the asphalt not only degrades the quality of the end product but also causes air pollution and subjects buildings and foliage adjacent the repaving operations to a danger of being set on fire.

Therefore, using known machinery and methods, it is only possible to effectively revitalize approximately one inch of an existing asphalt roadway surface. Layering new asphalt mix on top of a revitalized inch of road surface, or mixing new hot mix into the revitalized inch without treating the old asphalt surface below, the revitalized inch will not result in a road pavement with quality comparable to that of a brand new asphalt road. Such attempts can also prove expensive and time consuming.

OBJECTS AND SUMMARY OF THE INVENTION

It is a primary object of this invention to provide an improved method and apparatus for recycling and rejuvenating asphalt road surfaces using existing road materials restructured, reworked and combined with predetermined amounts of new asphalt hot mix and recycling agents, to result in a new pavement with quality characteristics rivaling those of a brand new asphalt road surface.

It is an associated object to provide a method and apparatus by which up to 2½or more inches of rejuvenated road surface can be provided in a single pass of a repaving apparatus.

Another object of the invention is to provide a method and apparatus capable of penetrating an old asphalt road surface with heat to a depth of approximately two inches and produce a high-quality repaved road surface without burning the asphalt being treated, polluting the surrounding air, or subjecting the adjacent structures and foliage to the risk of being set on fire.

It is yet another object of the invention to provide a method and apparatus capable of performing the above stated objectives at speeds of approximately 15 to 22 f.p.m.

Still another object of the invention is to provide method and apparatus for restoring asphalt road surfaces in a manner which corrects any problems associated with a previous repaving job performed on the road surface in question.

The method and apparatus disclosed herein provide for a series of process steps performed on a road surface by apparatus moving along the roadway comprising a continuing sequence of work stations. In accordance with a preferred embodiment of the invention, an old road surface is first heated by means capable of penetrating the road surface to a predetermined depth of approximately one inch without burning it. Immediately thereafter, the old road surface is scarified to break up and loosen the surface layer just heated. Liquid recycling oils may then be applied to the heated, scarified road material in order to revitalize, chemically, the internal adhesive qualities of the asphalt. Leveling screws and blades next gather and mix to form a recycled hot mix which is then leveled further and laid by a repaving screed.

Next, a predetermined quantity of new hot mix is provided atop the newly created recycled hot mix. Initially, the new hot mix is delivered via dump truck to a hot mix receiving hopper located in front of the heating apparatus means discussed above. From there, the new hot mix is conveyed above the work stations already discussed, and dropped into a hot mix distribution funnel which uniformly distributes it on the road surface just beyond the repaving screed.

Milling cutters next work and mix together the recycled hot mix and the recently added quantities new hot mix under appropriate conditions to form a mixed material which is thrown upwardly and rearwardly by the rotation of the milling cutters onto a second conveyor means extending back toward a paving station disposed near a rear portion of the repaving apparatus. Removal of this mixed material by the second conveyor exposes a smooth, black sub-surface left by the milling cut an enables a second series of work stations located vertically beneath the second conveyor to penetrate heat deep into the roadway and revive the buried sub-layer of old asphalt into what will become an integral component of a new welded road surface as described in detail below Accordingly, the now exposed sub-layer is heated by second heating means immediately following the milling cutters and similar in form to those provided in the initial stage of the repaving operation. Similarly, means for scarifying the sub-layer, coating it with recycling oil, and mixing and leveling comprise separate work stations that follow in line behind the second heating means. This processing of the sub-layer removes existing defects and revitalizes the sub-layer into a monolithic material with which the mixed material will later be combined to form a new pavement.

Ultimately, a paving station is provided at which the second conveyor deposits the mixed material onto the now properly prepared sub-layer to form a new welded road surface. This new road surface comprises 2½ to about 3 or more inches of new pavement created in a single pass of the repaving apparatus and capable of withstanding traffic almost immediately after formation. Moreover, the described method of first treating an upper layer of road surface, conveying it away and then similarly treating a sub-layer exposed by a milling cut, enables the apparatus to heat and revitalize approximately two inches of existing asphalt road surface, and combine it with quantities of new hot mix to create a new high-quality road surface.

Thus, by way of further summary, a preferred form of the invention comprises a method that includes heating a top layer of roadway to a depth of approximately one inch, immediately scarifying said top layer, adding a recycling agent and mixing and screeding said top layer to form a recycled material, adding new hot mix to said recycled material and milling to form a mixed material of new hot mix and recycled material, conveying the mixed material to a paving station, and during said conveying, heating and scarifying a sub-layer exposed by the milling cut to a depth of approximately one inch, adding a recycling agent to said sub-layer and subjecting said sub-layer to a screeding action, then combining said mixed material with said sub-layer to form a new welded road surface.

In terms of the apparatus, the invention may, broadly speaking, be considered as an apparatus having means for heating a top-layer of roadway, means for scarifying said heated roadway, means for chemically treating said scarified layer, means for mixing and means for screeding to form a recycled material, means for delivering a new hot mix to a predetermined location for deposit on the recycled material, means for milling said recycled and new hot mix material to form a mixed material and leaving a milling cut in the roadbed of a predetermined depth thereby exposing a sub-layer, means offset from said first-mentioned heating means and said first-mentioned scarifying means for heating and scarifying the exposed sub-layer, means offset from said first-mentioned screed for screeding the sub-layer, and means for combining said mixed material with said sub-layer to form a new pavement surface.

DETAILED DESCRIPTION OF THE INVENTION

Figure 1:
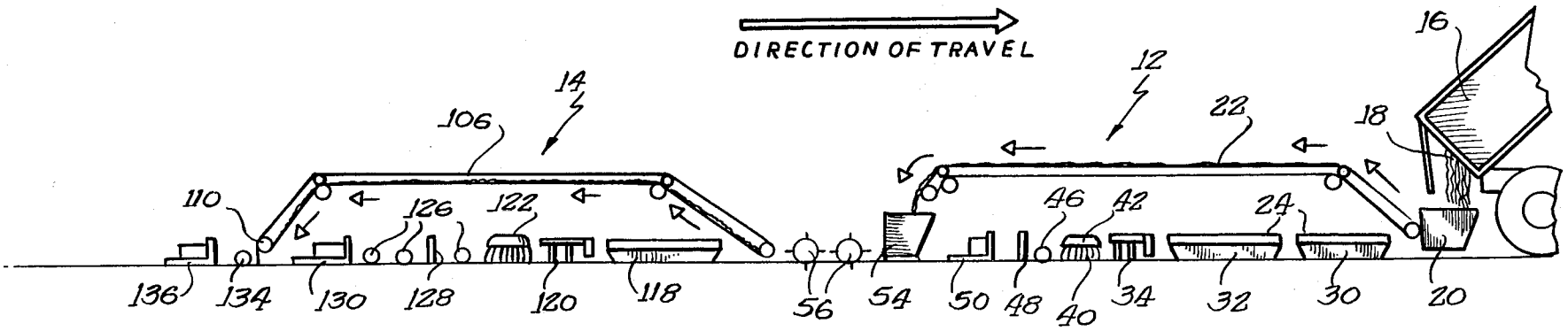
FIG. 1 is a side elevational view diagramatic in character, of the double-stage repaving method and apparatus shown receiving a supply of new hot mix from a dump truck which apparatus is constructed in accordance with and embodying the present invention.

While the invention will be described in connection with a preferred embodiment, it will be understood that it is not intended to limit the invention to that embodiment, rather, it is intended to cover all alternatives as may be included within the spirit and scope of the invention.

Referring now to the drawings, there is shown vehicles, namely a first-vehicle 12 and a second-vehicle 14 used to perform the double-stage repaving method. It will be appreciated however, that in carrying out the invention, both vehicles are used in end-to-end relationship.

Figure 2:
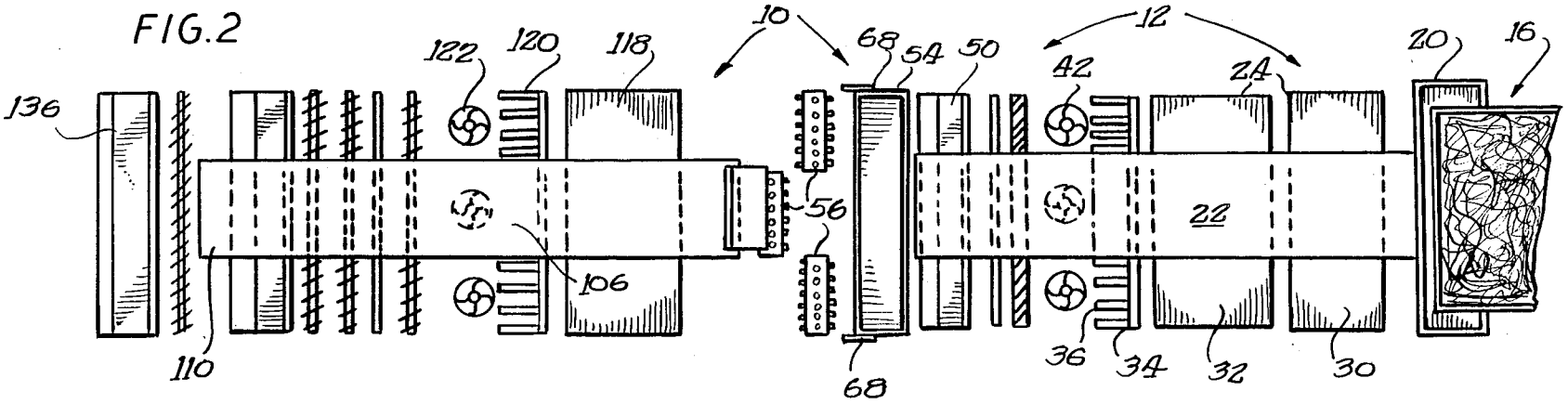
FIG. 2 is a plan view of the method and apparatus shown in FIG. 1.

Referring first to FIGS. 1 and 2 which show the repaving process schematically, and initially focusing on the first-stage of the repaving process, there is shown a conventional dump truck 16 providing a supply of new hot mix 18 to a receiving hopper 20. The new hot mix 18, of fresh unused asphalt compound, is carried away from the dump area, and rearwardly on the vehicle 12, by a conveyor 22 which is operatively connected to the receiving hopper 20 for use at a later described work station in the repaving process. Behind the receiving hopper 20, opposite the direction of travel as indicated by the arrow in FIGS. 1 and 2, there is shown a first-stage flat-flame heating means 24. Flat-flame heating means 24 forms a first work station of, and performs a first step in, the double-stage repaving operation. More specifically, the heating means 24 delivers radiant heat to penetrate an upper surface 26 of an existing roadway surface 28 over which the heating means 24 travels. Design specifications contemplate heat penetration to a depth of approximately 1 inch. As illustrated, a first heater 30 is preferably rated at approximately 7.5 million BTU and is spaced immediately ahead of a second heater 32 which is preferably rated at approximately 15 million BTU. So arranged, the two heaters 30 and 32 pass over the road surface 28 at speeds of from 15 to 22 feet per minute and raise the upper inch of the roadway surface 26 to working temperatures of about 400 degrees Farenheit. Since a flashpoint of approximately 475 degrees Farenheit is a common characteristic of most asphaltic cements which form part of the existing asphalt surface 28 as discussed above, the heating means 24 will heat the upper inch 26 without burning the road surface or affecting obstacles such a trees and buildings nearby.

Figure 3:
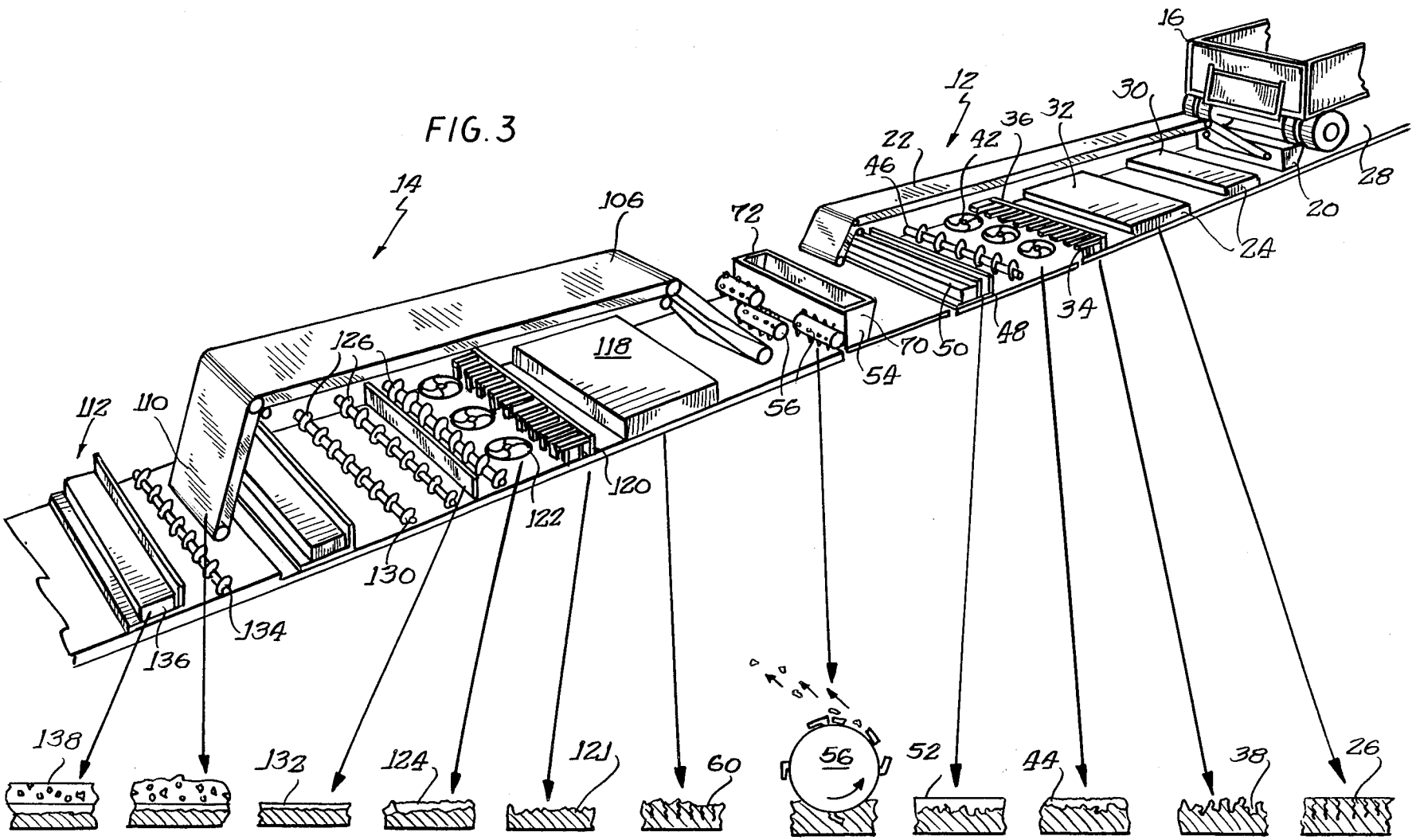
FIG. 3 is a perspective view of the double-stage repaving method and apparatus also showing broken out sectional elevational enlarged views of the roadway at various intervals during the repaving process.

Immediately following the heating of the upper layer 26, unseparated by vehicle drive means or dump trucks, scarification of upper layer 26 comprises the next step in the repaving method. To this end, air bag scarifiers 34 form the next work station of the road repaving apparatus. Constructed substantially as set forth in my earlier U.S. Pat. No. 3,907,450, the scarifiers 34 have blades 36 which are urged against the road surface by means of air-operated bags which apply pressure to scarifying blade holding arms (not shown). The blades 36, which can be carbide tipped for maximum wear resistance, excavate the heated upper surface 26 leaving a broken, loosened road surface 38 as depicted in an enlarged sectional broken out view in FIG. 3.

The broken, loosened road surface 38 is next treated with a recycling agent 40 by use of rotating applicators 42 located in line behind the scarifiers 34. The recycling agent 40 is preferably a type of liquid maltene oil which is a constituent of asphalt cement and functions to bond the various components together. As is common knowledge in the repaving industry asphaltic oils, such as maltene, in asphalt pavements come to the surface of the road over time. This occurence leaves behind a layer of pavement lacking the desired characteristics of a superior roadway surface. The addition of a recycling agent 40 via applicators 42 forms a composite material 44 having the requisite components of a high quality asphalt compound.

As final work stations of the first-stage of the repaving process, a mixing screw 46, a leveling blade 48 and a repaving screed 50 are provided. These work stations pass over and thoroughly mix and level out the composite surface 44 to form a recycled hot mix 52. The recycled hot mix 52 conforms substantially to the characteristics of new asphalt compound normally used for laying brand new roadways.

Before moving to a complete discussion and description of the second-stage of the repaving process, it will be recalled that at the outset, new hot mix 18 was delivered to the receiving hopper 20 to be carried off by first-stage conveyor 22. The conveyor 22 conveys the new hot mix 18 vertically above the work stations already discussed, and deposits it in a distribution funnel 54 which, in a preferred embodiment, comprises a first work station of the second-stage of the repaving process. This second-stage distribution funnel 5 receives and distributes the new hot mix 18, in quantities of approximately 35 to 200 pounds per square yard of production and at of temperatures of approximately 300 degrees Farinheit, directly upon the recycled hot mix 52 on the roadway in a uniform and continuous manner. It will be noted that because of the close proximity of the first-stage work stations as described above, the recycled hot mix 52 will still be quite hot when the new hot mix 18 is added to it. Having the temperatures of both the recycled hot mix 52 and the new hot mix 18 elevated at this point in the double-stage repaving process is important for two reasons. First, it creates proper conditions for combining the materials which occurs immediately after the distribution funnel 54 distributes the new hot mix 18 by way of staggered, contoured rotary milling cutters 56, best shown in FIG. 3 and 4, which mix and work the recycled hot mix 52 and the new hot mix 18 together to form a mixed material 58. As will be recalled, the asphalt cements in the road become flowable liquid at 300 degrees Farenheit and will flow evenly over the asphalt components and bind them together during this milling operation.

Secondly, mixing the recycled hot mix 52 and the new hot mix 18 at temperatures above 300 degrees Farenheit avoids problems associated with what is known in the repaving industry as "cold milling". "Cold milling", meaning milling asphalts at ambient temperatures, quickly wears out the milling cutters 56 and requires rotating the cutters with very high horse power. Moreover, "cold milling" tears apart the asphalt cements contained in the pavement surface, creates "fines", or very fine particles, which are difficult to remove and leaves the pavement in a weakened condition that cannot carry heavy traffic. At temperatures above 300, asphalt milling can be performed with lower horse power and the milling cutters 56 have a life span 15 to 20 times as long as cutters performing "cold milling".

Figure 4:
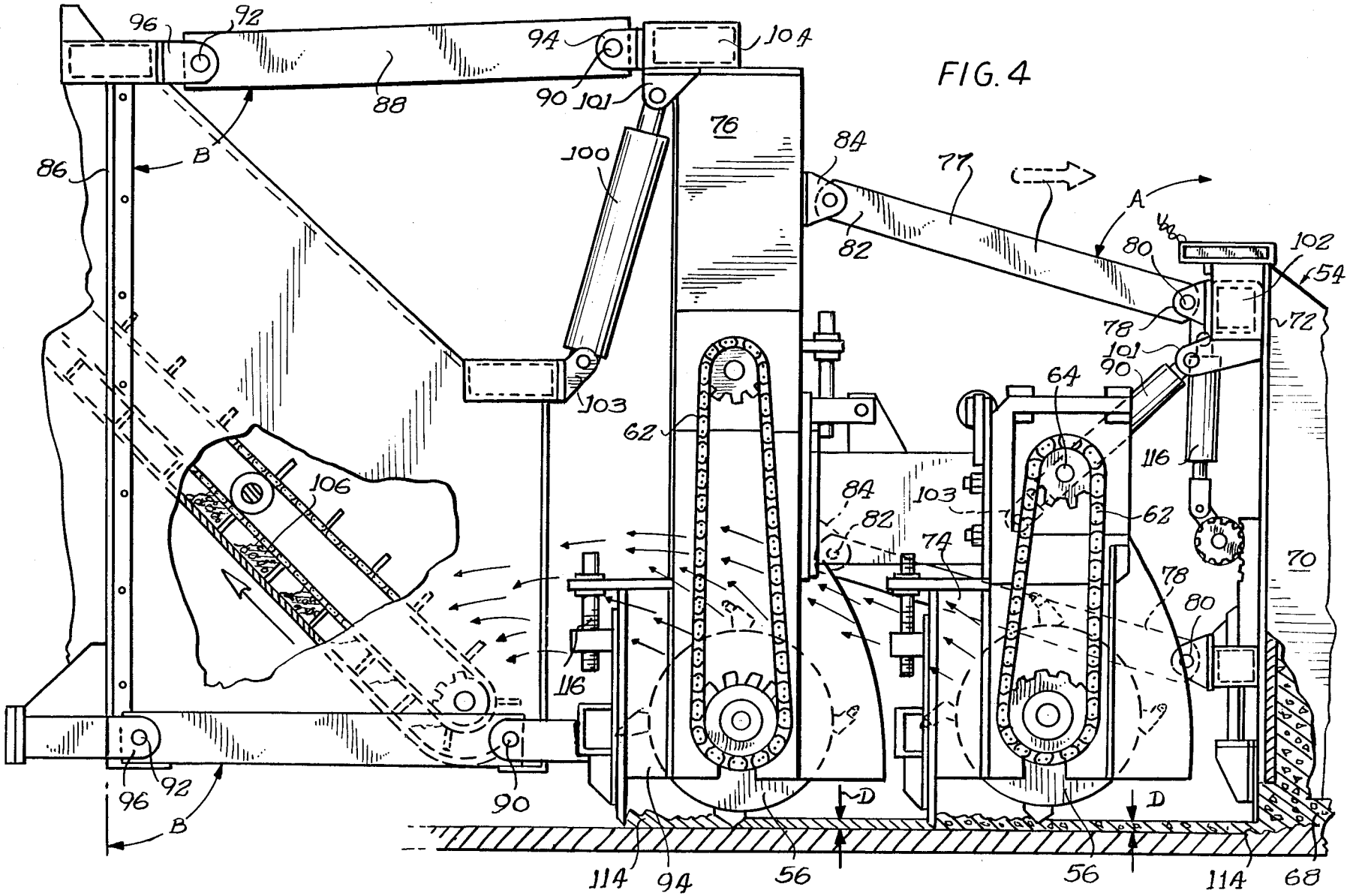
FIG. 4 is an enlarged sectional side view of the milling means portion of the repaving apparatus partially broken away and in section and which forms part of the present invention.

During the milling operation, in addition to forming mixed material 58, the milling cutters 56, which are driven by sprocket and chain means 62 and 64 (FIG. 4), perform a second function. That is, the milling cutters 56 leave a cut in the road surface 28 which exposes a sub-layer 60 located beneath recycled hot mix 52. It is important to control precisely a depth-of-cut D made by the milling cutters 56 due to problems associated with "cold milling", discussed above. Accordingly, depth control means 66 are provided employing the general principles of my earlier U.S. Pat. No. 4,103,973 and to which reference may be had. FIG. 4 shows an enlarged side elevational view of a work station comprising the milling cutters 56, and the depth-of-cut control means depicted generally as 66. In order to provide a smooth, controlled milling cut operation, the depth-of-cut control means 66 has elongated depth control shoes 68 which are securely mounted on each of two outwardly facing sidewalls 70 of the distribution funnel 54. The distribution funnel 54 also has a rear wall 72. Extension arms 74 are provided to connect distribution funnel 54 with a milling cutter support frame 76 to allow for relative limited vertical movement therebetween by pivotally attaching extension arm ends 78 to pivot pins 80 provided on the rear wall 72 of the distribution funnel 54 and pivotally attaching the opposite ends 82 of arms 74 to ears 84 provided on support frame 76. The support frame 76, on which the milling cutters 56 are rotatably mounted, is in turn pivotally mounted on pivot pins 90, 92 for limited vertical movement relative to a main frame 86 through the movement of brace arms 88. The brace arm pivot pins 90 and 92 pivotally attach to rear support frame flanges 94 and main frame flange means 96, respectively. Pairs of fluid power cylinders at opposite sides of the apparatus (one such cylinder of each pair 98 and 100 being shown) provide for selectively controlling the vertical movement of both the distribution funnel 54 and the support frame 76, independently, relative to main frame 86. These cylinders are preferably supported on pairs of brackets 101 and 103.

In operation, elongated depth control shoes 68 ride upon a road surface at which new hot mix 18 has just been laid atop recycled hot mix 52. The desired depth-of-cut D, in relation to the level of the control shoes 68, can be determined by knowing the combined thickness of the recycled hot mix 52 and the new hot mix 18.

Adjusting cylinder 1 will pre-set support frame 76, and thus the milling cutters 56, relative to the level of control shoes 68 to obtain the desired depth-of-cut D. An angle A will now exist between extension arms 74 and the distribution funnel rear wall 72. Likewise, a second angle B will exist between brace arms 88 and main frame 86.

In order to maintain the same variance, in degrees, between angles A and B, and thereby maintain the same vertical relationship between control shoes 68 and support frame 76, first and second sensing means 102 and 104 are provided. It will be appreciated, that controlling these vertical relationships, also enables precise control of the depth-of-cut D. For example, when discontinuity in the road level 28 being treated by the double-stage repaving apparatus 10 is encountered, distribution funnel 54 will ride vertically upward or downward on elongated control shoes 68, thereby extending or compressing fluid power cylinder assembly 98. This in turn will cause angle A to increase or decrease accordingly.

First sensing means 102 (FIG. 4), of known type and kind, will accurately detect any change in angle A and electronically signal second sensing means 104, also of known type and kind, which consequently will electronically trigger a suitable solenoid value (not shown) to operate hydraulic cylinders 1 to raise or lower milling cutter support frame 76 such that the same variance initially existing between angles A and B is restored. The electro-hydraulic circuitry for operating the cylinders is conventional and need not be described in detail here. By this method, a constant depth-of-cut D is achieved despite road level discontinuity without putting unnecessary stresses and strains on the second-stage repaving apparatus 14 which would otherwise occur were the described apparatus 14 assembled in a rigid manner.

Referring again to the description of the road surface being treated, once the recycled hot mix 52 and the new hot mix 18 have been thoroughly milled and mixed together by milling cutters 56, the rotating milling cutters 56 further serve to throw the mixed material 58 onto a double-chain second-stage conveyor 106 having one end 108 positioned directly behind the milling cutters 56 to receive the mixed material 58 and another end 110 disposed adjacent a paving station 112 described below. The second-stage conveyor 106 transports the mixed material 58 vertically overhead the remaining second-stage apparatus described below in much the same manner that the first-stage conveyor 22 transports the new hot mix 18 above the first-stage apparatus 12. Gates 114, and gate adjustment means 116, are provided for both the milling cutters 56 and the distribution funnel 54 in order to aid in leveling and containing the worked road surface as well as facilitate the loading of the mixed material 58 onto the conveyor 106.

Treatment of the smooth, black sub-layer 60 exposed by the milling cutters can now be performed by first providing second-stage heating means 118, which may for example be rated at 15 million BTU. Heating means 118 places heat deep into the road surface 28 by heating approximately one inch of sub-layer 60 in much the same manner as heating means 24 heated top layer 26, above. Next, a second sequence of workstations comprising second-stage vehicle 14 works the sub-layer 60 by scarifying with second-stage scarifiers 120 to form a broken, loosened surface, applying recycling agent 40 with second-stage rotary applicators 122 to form a sub-level composite layer 124, and finally mixing and leveling the sub-layer 60 with second-stage mixing screws 126, a leveling blade 128 and second-stage screed 130.

A treated, revitalized sub-layer plane 132, devoid of cracks, separations and other defects which may have resulted from previous resurfacing attempts, now forms a smooth surface upon which the mixed material 58 can be laid. At the paving station 110, the mixed material 58 is uniformly layered on top of the revitalized sub-level plane 132 and worked by a final screw mixer 134 and a final screed 136. As a result of the rapid rate of movement of the repaving apparatus along the roadway as discussed above, both the mixed material 58 and the revitalized sub-level plane 132 remain heated above approximately 250 degrees Fahrenheit at the paving station 110. This heat enables proper material bonding and compaction and results in a new, welded, monolithic road pavement 138, approximately 2½ to 3 inches thick being produced at speeds of up to 22 f.p.m. The new pavement 138 has long lasting quality characteristics similar to those of brand new factory-made asphalt compounds. The high-quality new pavement 138 owes its existence to the innovative process described which allows deep heating and working of an existing roadway 28.

Figure 5A:
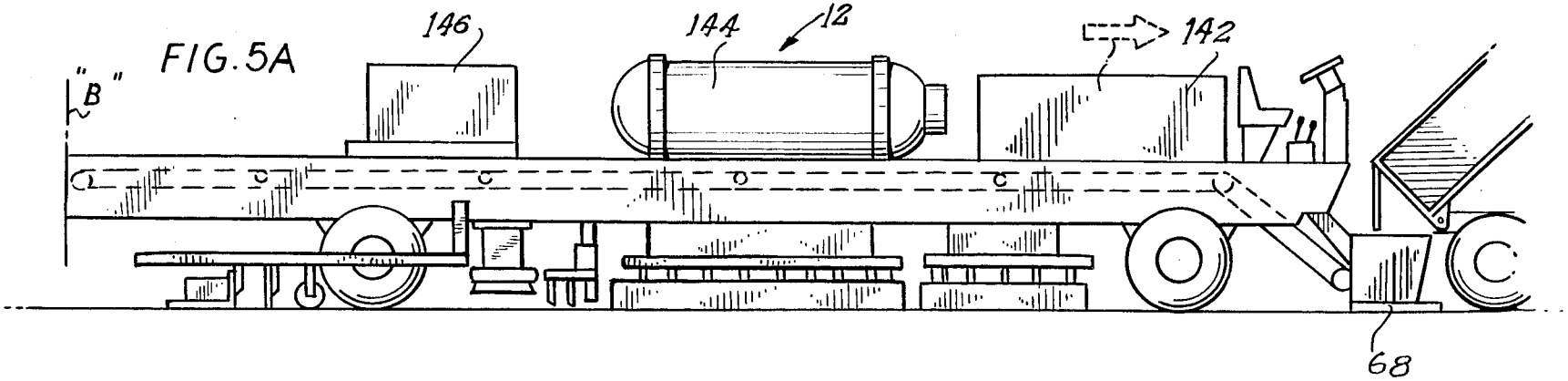
FIGS. 5(*a*) and 5(*b*) show elevational side views of the repaving apparatus embodied in a first-stage vehicle (FIG. 5(*a*)) and a second-stage vehicle (FIG. 5(*b*)) which when placed together in end-to-end relationship at broken line B show the vehicles constituting the apparatus forming the present invention.
Figure 5B:
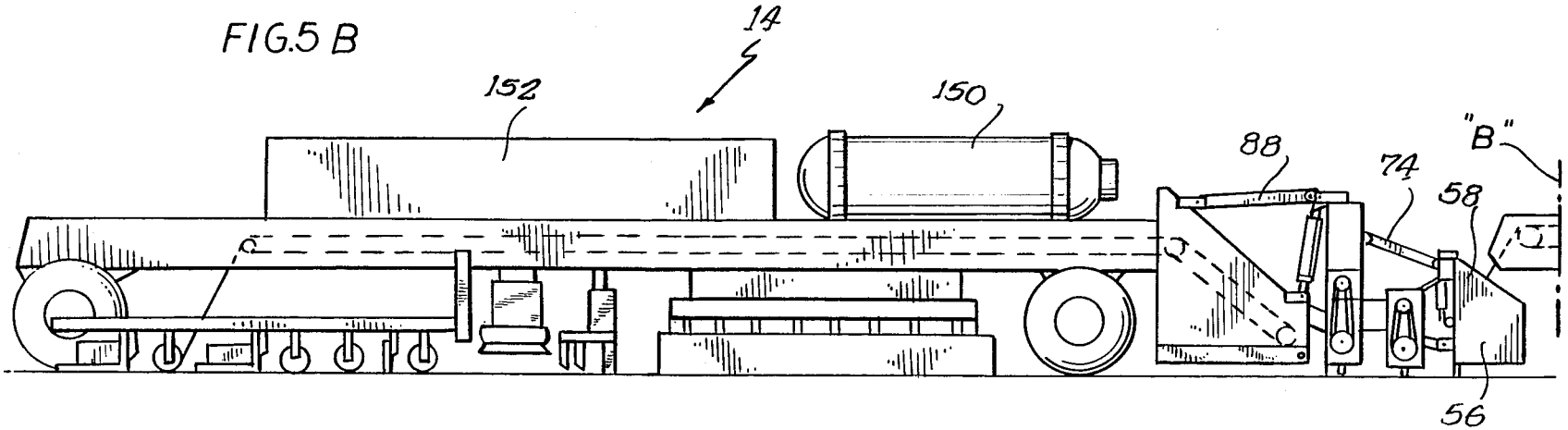

Preferably, as shown in FIGS. 5(*a*) and 5(*b*), the first-stage vehicle 12 incorporates the first-stage work stations and the second-stage vehicle 14 incorporates the second-stage work stations. First-stage vehicle 12 has independent drive means 142, heating means fuel supply 144, and recycling agent supply means 146. Similarly, FIG. 5(*a*) shows that second-stage vehicle 14 houses second-stage heating means fuel supply 150 and recycling agent supply and independent drive means 152.

Figure 6A:
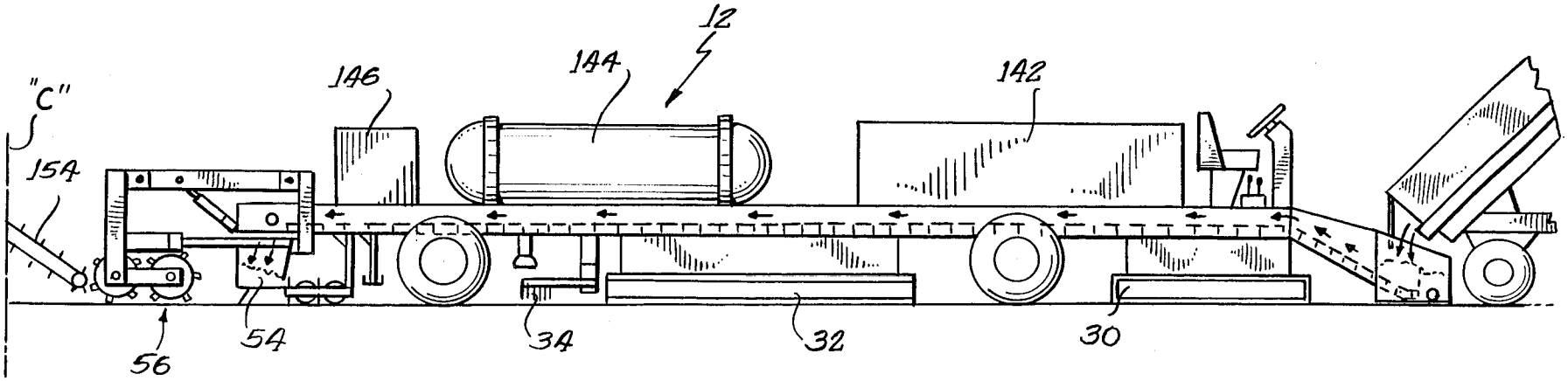
FIGS. 6(*a*) and 6(*b*) show elevational side views of the repaving apparatus in alternative embodiments of a first-stage vehicle (FIG. 6(*a*)) and a second stage vehicle (FIG. 6(*b*)) which are placed together at broken line C in operation.
Figure 6B:
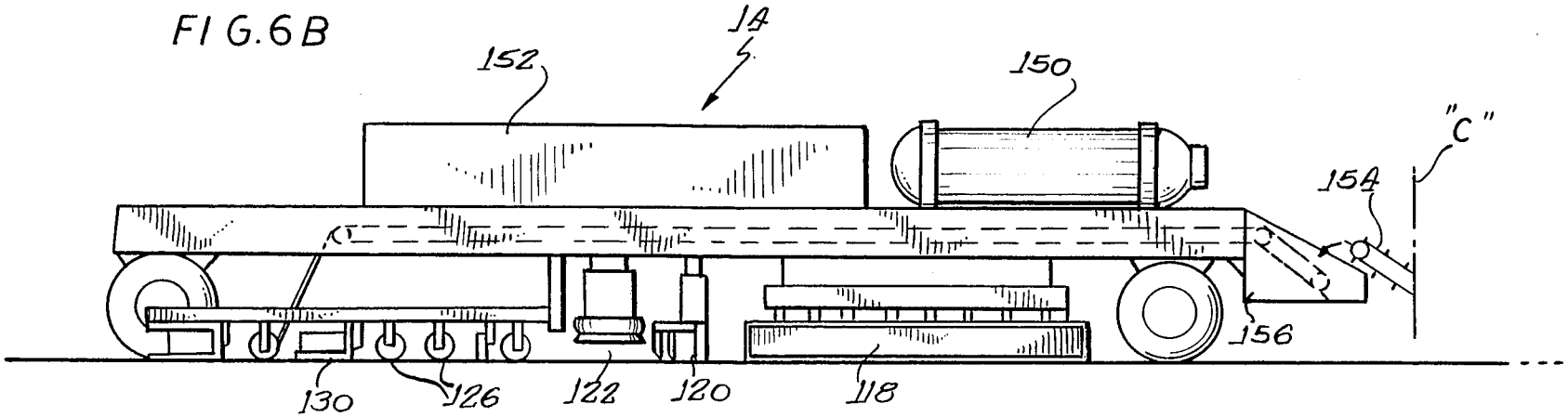

FIGS. 6(*a*) and 6(*b*) show an alternative embodiment of first-stage vehicle 12 and second stage vehicle 14 wherein the distribution funnel 54 and milling cutters 56 are located near the rearward end of vehicle 12 and wherein like parts are similar to corresponding parts in FIGS. 5(*a*) and 5(*b*). Elevator 154 is also provided on vehicle 12 in FIG. 6(*a*) to elevate the mixed material 52 into a second receiving hopper 156 operatively connected to second conveyor 106 on vehicle 14 in FIG. 6(*b*).

It will be apparent that FIG. 5(*b*) is a lengthwise continuation of FIG. 5(*a*) and that FIG. 6(*b*) is a lengthwise continuation of FIG. 6(*a*) when the two sets of figures are placed together in end-to-end relationship at broken lines, B and C, respectively and that the use of first and second-stage vehicles of the foregoing is by way of example only and is not a limitation on the invention.

The invention is claimed as follows:

1. A method of restoring an asphalt roadway comprising the steps of heating an upper layer of existing roadway, scarifying the heated existing roadway surface to a predetermined depth to obtain a broken, loosened road material, adding a recycling agent to the loosened road material, mixing and screeding said loosened road material to form a recycled hot mix on the roadway, adding a new hot mix to said recycled mix in a heated condition, subjecting the recycled hot mix and the new hot mix to a milling action of predetermined depth to form a mixed material and leave a milling cut in the roadway, picking up and conveying the mixed material to a paving station, heating the part of the roadway that is at and below the aforesaid milling cut, scarifying said last-mentioned heated roadway part and combining the mixed material with the scarified roadway part at said paving station to form a new road surface.

2. A method according to claim 1, further including adding a recycling agent to said last-mentioned heated roadway part and mixing, leveling and screeding said last-mentioned heated roadway part prior to combining the mixed material at said paving station.

3. A method of restoring an asphalt roadway comprising the steps of heating a top layer of roadway to a predetermined depth without burning said roadway, scarifying said layer and adding a recycling agent thereto as steps in forming a recycled material, adding pre-heated new hot mix to said recycled material to form a double-layer on the roadbed, milling the double-layer to form a mixed material of new hot mix and recycled material, conveying the mixed material to a paving station, and during said conveying scarifying a heated sub-layer, chemically treating said sub-layer and subjecting said sub-layer to a screeding action, and applying said mixed material on the roadbed over the sub-layer forming a new welded, monolithic road surface.

4. A method of continuously restoring an asphalt roadway with equipment moving along the roadway comprising the steps of heating a first upper layer of existing roadway below a known flashpoint of said first upper layer, scarifying and processing said first layer to provide a heated layer of recycled hot mix on the roadway, applying a heated layer of new hot mix on the layer of recycled hot mix, milling the layers of recycled hot mix and new hot mix for forming a mixed material and a milling cut in said roadway, removing said mixed material from the roadway and conveying the mixed material to a paving station, heating a second layer of said roadway beneath the milling cut, scarifying and processing said second layer to provide a second heated layer of recycled hot mix on the roadway and applying said mixed material over said second layer of recycled hot mix to form a new roadway surface.

5. A method according to claim 4, further comprising the step of maintaining said heated layer of recycled hot mix and said heated layer of new hot mix forming said mixed material in a heated condition above a predetermined temperature while being conveyed to said paving station and while being applied to said second layer of recycled hot mix, said second layer of recycled hot mix also being maintained in a heated condition above said predetermined temperature thereby enabling production of a new, welded, monolithic roadway surface.

6. The method according to claim 4, wherein said processing of said first and second layers of roadway forming said recycled hot mix layer and said second recycled hot mix layer, respectively, comprises applying a recycling agent, mixing, leveling and screeding the layers.

7. Apparatus for restoring a roadbed comprising means for heating a top layer of roadway, means for scarifying said heated roadway, means for chemically treating said scarified layer, means for screeding as steps in forming a recycled material, means for delivering a new hot mi to a predetermined location for deposit on the recycled material, means for milling said recycled and new hot mix material to form a mixed material and leaving a milling cut in the roadbed of a predetermined depth, means offset from said first-mentioned scarifying means and said first-mentioned heating means for heating and scarifying the roadway below the milling cut to form a treated sub-layer, means offset from said first-mentioned screed for screeding the last-mentioned sub-layer, and means for applying said mixed material to said sub-layer as a pavement surface.

8. Apparatus according to claim 7 in which there is a first conveyor extending from substantially the front of the apparatus rearwardly back, said first conveyor having means for delivering said new hot mix onto said recycled material at a region intermediate the opposite end of the apparatus, a second conveyor extending rewardly from said intermediate region to a paving station, and said milling means being at said intermediate region and having means for mixing said new hot mix and said recycled material and depositing the mixture on said second conveyor.

9. Apparatus for restoring a road surface, said apparatus comprising first, intermediate and final segments said first segment having means for receiving a new hot mix and conveying the new hot mix to the intermediate segment, and means for forming a recycled upper layer of road surface, said intermediate segment having means for receiving and layering said new hot mix being conveyed from said first segment onto said recycled layer formed by said first segment, milling head means for combining said new hot mix layer and said recycled layer into a mixed material for and loading said mixed material onto a final segment conveyor thereby exposing a sub-layer in the road surface, said final segment further having means for treating said sub-layer, means for distributing said mixed material onto the treated sub-layer and means for screeding said mixed material and said sub-layer to form a new, welded road surface ready for traffic flow.

10. Apparatus according to claim 9 which said first segment means for forming a recycled upper layer of road surface comprise means for heating said upper layer of said road surface to a predetermined depth, means for scarifying said heated upper layer to form a broken, loosened surface, means for introducing a recycling agent to said broken, loosened surface, and means for mixing, leveling and screeding said broken, loosened surface to form a recycled hot mix.

11. Apparatus according to claim 9 in which said means for treating said sub-layer comprise means for heating said sub-layer to a predetermined depth, means for scarifying said sub-layer, means for introducing a recycling agent to said sub-layer, and means for leveling, mixing, and screeding said sub-layer to form a defect-free foundation upon which said mixed material can be laid.

12. Apparatus according to claim 9 in which said first and intermediate apparatus segments comprise a first vehicle, and said final apparatus segment comprises a second vehicle to follow said first vehicle along a roadway.

13. Apparatus according to claim 9, wherein a first vehicle comprises said first apparatus segment, and a second vehicle comprises said intermediate apparatus segment combined with said final apparatus segment.

* * * * *